United States Patent [19]

Gallatin et al.

[11] 4,376,271

[45] Mar. 8, 1983

[54] POLARIZED DC CONTACTORS

[75] Inventors: Paul M. Gallatin, Picayune, Miss.; Roger L. Robertson, Slidell, La.

[73] Assignee: Siemens-Allis, Inc., Atlanta, Ga.

[21] Appl. No.: 274,769

[22] Filed: Jun. 18, 1981

[51] Int. Cl.[3] ..... H01H 9/00

[52] U.S. Cl. ..... 335/159; 200/147 A; 361/210

[58] Field of Search ..... 335/159, 160, 128; 361/210; 200/147 A

[56] References Cited

U.S. PATENT DOCUMENTS 2,650,966 9/1953 Yingst ..... 200/147 A

*Primary Examiner*—Harold Broome

*Attorney, Agent, or Firm*—Frederick W. Powers, III

[57] ABSTRACT

Means for causing the properly-polarized one of a pair of series-connected DC contactors to open before the other, depending upon the direction of load current flow. Load current is caused to link the magnetic circuit constituted by a contactor coil, frame and armature; with current flowing in a first direction, the linking has an additive effect, strengthening the MMF in the magnetic circuit. When current flows in the opposite direction, the MMF is weakened which allows the contactor to open more quickly.

11 Claims, 5 Drawing Figures

POLARIZED DC CONTACTORS

BACKGROUND OF THE INVENTION

The present invention relates to DC circuit interrupters, and more particularly to DC contactors of the polarized variety.

Contactors for interrupting DC current are frequently used in pairs, connected to each end of a load so that circuit interruption effectively isolates the load from the source of DC power. Although in principle such contactors are simply switches which open and close a circuit in practice they are highly specialized devices, frequently incorporating arc extinguishing mechanisms. Arcs are commonly extinguished in such circuit interrupters by providing an arc chute incorporating a series of fins, plates or baffles, and means for forcing the arc which is drawn between the contacts into the baffle area where it is stretched, cooled, and finally extinguished. An arc, being formed by an electrical current, is responsive to a magnetic field according to the well known right-hand rule, and magnetic fields are commonly utilized to urge an arc from between a pair of separating contacts into an arc chute where it is extinguished or "blown out." The magnetic blowout mechanism may be comprised of an electromagnetic coil, sometimes termed a "blowout coil." More compact, less expensive structures may make use of permanent magnets, in which case a current-carrying coil is unnecessary. With electromagnetic blowout coils, however, load current is used to energize the coil so that the direction of the magnetic field reverses when load current reverses. With both the load (arcing) current and magnetic field reversed, the net effect is the same and the arc continues to move in the same direction, i.e., into the arc chute. However, when permanent magnets are used the magnetic field direction is constant, and hence when the direction of load current changes the magnetic field moves the arc in the opposite direction—away from the arc chute and into the contactor mechanism. Such an occurrence is obviously detrimental to the device, and may destroy it. For this reason it is conventional to establish a mandatory current direction through such devices. Such contactors are referred to as "polarized" contactors. Of course, it is possible to adapt such a device to accept current at either of its terminals by the addition of rectifiers or the like, but in practice such adaptations are uneconomical and conventional practice is to simply mark the terminals with plus and minus signs, to indicate preferred direction of current flow.

In the past this problem has been addressed in numerous ways. For instance, double break individual contactors may be provided, having both polarities of permanent magnets and utilizing the appropriate set of contacts and magnets, depending upon current direction. This obviously requires a redundant set of contacts and magnets, and switching or rectifying apparatus for directing current only through the appropriate contacts. Another, straightforward approach is to control the opening times of two different contactors, so the properly-polarized one is actuated before the other. This requires not only additional sophistication in the control function for selectively timing operation of the contactors, but in addition means for sensing the direction of current flow, and effecting a change in the control system. Alternatively, a line current polarity sensor could be built into a contactor for imparting a delay into the control mechanism by means of timers, RC circuits, or the like. All of these approaches, however, involve the addition of numerous components with the attendent cost and effect upon reliability. It will therefore be appreciated that it would be highly desirable to provide means for causing only the appropriately-polarized one of a set of polarized DC contactors to interrupt load current.

It is therefore an object of the present invention to provide an improved polarized contactor for use with bidirectional DC current.

Another object is to provide a contactor system in which the properly-polarized one of a pair of contactors operates to initially break a circuit.

Yet another object is to provide for the sequential operation of a pair of polarized contactors, in a sequence determined by current direction, which is simpler and more reliable than any heretofore known.

It is another object of the invention to provide a simple, inexpensive means for effecting the sequential operation of a pair of polarized DC relays, depending upon the direction of current flow.

SUMMARY OF THE INVENTION

Briefly stated, in accordance with one aspect of the invention the foregoing objects are achieved by providing a pair of circuit interrupters each of which has a pair of separable contacts, permanent magnetic arc extinguishing means, and a magnetic circuit including an armature coupled to one of the contacts, a magnetic frame and an electromagnetic coil. A conductor carrying load current is connected to one of the contacts, and disposed in the magnetic circuit so that it links the circuit. The direction of DC current flow through the contacts determines whether the linkage is additive or subtractive. The contactor is connected in the circuit so that current flowing in a direction compatible with arc extinguishment by the permanent magnet blowout assembly links the magnetic circuit in a subtractive mode, while current flowing in the opposite direction links the magnetic circuit additively.

Contactors are disposed in series with a load to be disconnected such that current flows through them in opposite directions. When the electromagnetic coils of the contactors are simultaneously deenergized, the contactor in whose magnetic circuit the MMF is weakened by the subtractive linkage of the load current-carrying conductor opens more rapidly than the contacts of the other contactor, whose magnetic circuit is additively linked. In this manner circuit interruption, and thus arcing, is borne by that contactor having the appropriately-polarized magnetic blowout means. Operation of the other contactor is delayed with respect to the first one due to the presence of the aiding MMF.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
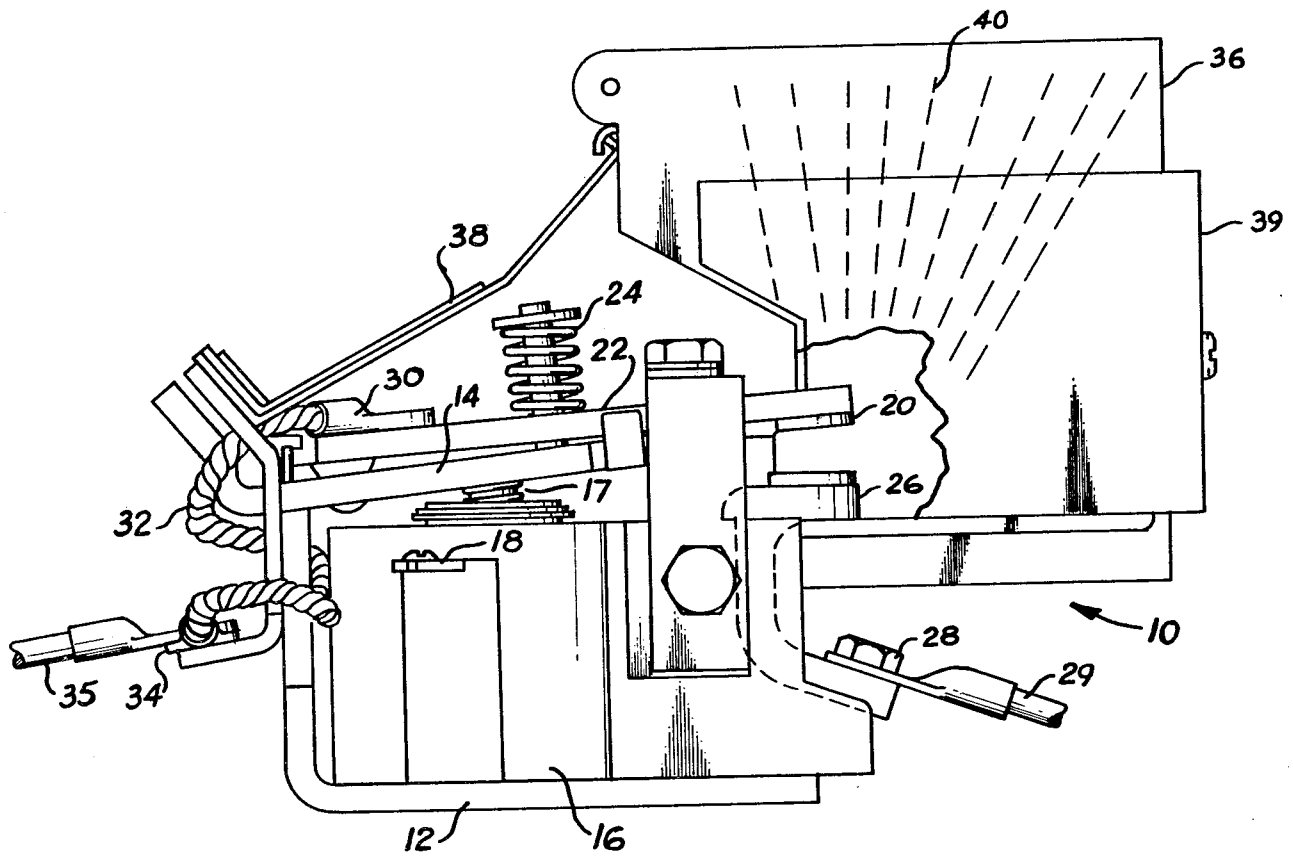
FIG. 1 is an elevational view of a DC contactor embodying the present invention.

A polarized DC contactor generally indicated at 10 includes a magnetic circuit consisting of a frame 12, armature 14 and coil 16. A spring 17 biases the armature away from the coil. As is familiar to those skilled in the art, the coil comprises a number of turns of fine wire and encloses a magnetic core and is in magnetic communication with frame 12 and armature 14. A relatively small control current may be introduced into coil 16 through a conductor attached to terminal 18, giving rise to sufficient magnetomotive force (MMF) to actuate the device. In a preferred embodiment a movable, upper contact 20 is attached to a pivoted arm 22 which is coupled to armature 14 by means of a spring 24. A second, fixed contact 26 is attached to the frame or stationary or mounting structure of the contactor by means of bolt 28, which also may serve as an anchoring point for an electrical conductor 29 carrying load current. Load current from movable contact 20 flows through arm 22 and by way of a brazed-on connector 30 or the like into a flexible conductive lead 32. The lead is threaded between coil 16 and frame 12, and attached to a second, fixed terminal 34 to which can be attached another load-current carrying conductor 35.

A conventional arc chute 36 is attached to the contactor, and held in place by means of arm 38. Permanent magnets are disposed on either side of the arc chute, within a frame 39 of magnetic iron or the like. Within the arc chute a series of fins, plates or baffles, indicated by dashed lines 40, provide an arc stretching and quenching function, as will be explained hereinafter.

Figure 2:
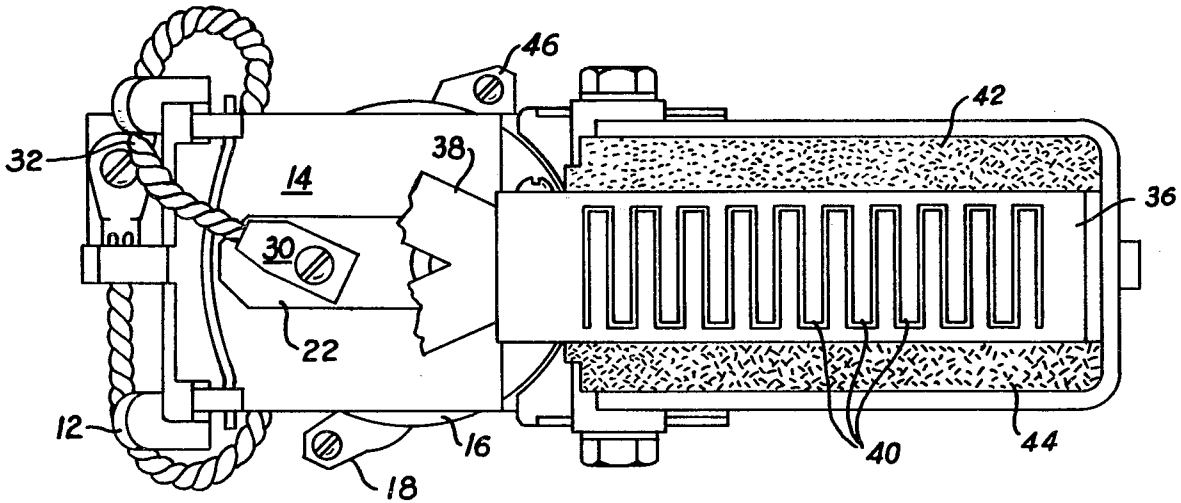
FIG. 2 is a top view of the contactor of FIG. 1.

FIG. 2 further illustrates the construction of the arc chute, and the interrelationship of baffles 40. In addition a pair of preformed permanent magnets 42, 44 are shown disposed on either side of the arc chute. As is conventional, the magnets are polarized to produce a magnetic field extending transversely across the arc chute from one magnet to the other so that frame 39 provides a return path to complete the magnetic circuit.

Arm 38 is shown broken away so that armature 14 and arm 22 are more readily seen. The brazed-on terminal 30 is seen attached to the upper surface of arm 22, and lead 32 extends downwardly and is threaded between coil 16 and frame 12. A second terminal 46 is provided to complete the current circuit through coil 16.

The operation of the contactor of FIGS. 1 and 2 occurs in response to the flow of current through coil 16 from a remote control mechanism, which may be a simple switch in series with a current source, activated by some external stimulus such as the sensing of an overcurrent condition, manual operation of a control mechanism, or the like. Spring 17 biases armature 14 upwardly, thus keeping the contacts in a normally open mode in the absence of energization of coil 16. At this time, of course, no current flows through the load circuit. When it is desired to close the contactor and initiate current flow current is applied to coil 16, flowing through terminals 18 and 46. The current flow through the turns of wire within coil 16 produces an electromagnetic field which extends through the core of coil 16, through frame 12, and armature 14. The magnetic forces thus produced draw the armature downwardly against the upper end of coil 16 in the conventional manner, urging contacts 20 and 26 tightly together so that current may flow from one external terminal 28 to the other 34 or vice versa, depending upon the polarization of the current source.

When it is necessary to interrupt the circuit current flow to coil 16 is terminated, causing the MMF which it produced in the magnetic frame and armature to cease. As the MMF decays, spring 17 overcomes the magnetic force and urges armature 14 and arm 22 upwardly, separating the contacts. The current does not terminate immediately but rather establishes an arc between the separating contacts. The arc, extending between the contacts, is transverse to the magnetic field established by permanent magnets 42, 44. With the current flowing in a first, proper direction the resulting force urges the arc transversely to the right in FIG. 1 and upwardly, into the arc chute. As the arc is urged upwardly by the magnetic field it encounters the baffles 40, whereupon the arc elongates as it stretches about the baffles, is cooled, and eventually is extinguished.

With electromagnetic blowout coils, the direction of the magnetic force transverse to the arc chute reverses when load current reverses, so that the interaction of current and magnetic field direction always produces arc motion in the same direction. However, with a polarized relay of the type described herein the direction of the magnetic field is constant. Therefore when current flows in a direction opposite to that just described, the arc which it produces is moved in the opposite direction to that described, that is, to the left and into the workings of the contactor. This is highly detrimental, even destructive, to the mechanism and must be avoided.

In systems in which the direction of DC load current is reversible, herein termed a bidirectional direct current source it is conventional to utilize a pair of contactors, either oppositely polarized or with a common polarization but reversely connected, and to provide some means for initially operating the properly-polarized one of the pair so that the circuit is broken, and the resulting arc interrupted, by the properly-polarized one of the two. The present inventors have discovered that the necessary differential or delaying effect may be accomplished without the use of special circuits, rectifiers, or sophisticated controls by directing load current in such a manner that it aids or weakens the MMF in the contactor magnetic circuit, depending upon the direction of current flow.

Accordingly, the present inventors thread a flexible lead 32 from movable arm 22 through a space between coil 16 and frame 12 so that the MMF which is set up by conductor 32 links the magnetic circuit. Depending upon the magnitude of the load current one or more turns of the load current-carrying conductor may be used, linking them with the magnetic circuit in the manner shown.

It will be understood that due to nonlinearities inherent in any electromagnetic system some minimum level of load current is required for the proper functioning of the depicted invention. Therefore it may not be effective at small fractions of rated current; however arcing, and therefore the need for sequential operation of the contactors, is insignificant or minimal at such current levels.

Figure 3:
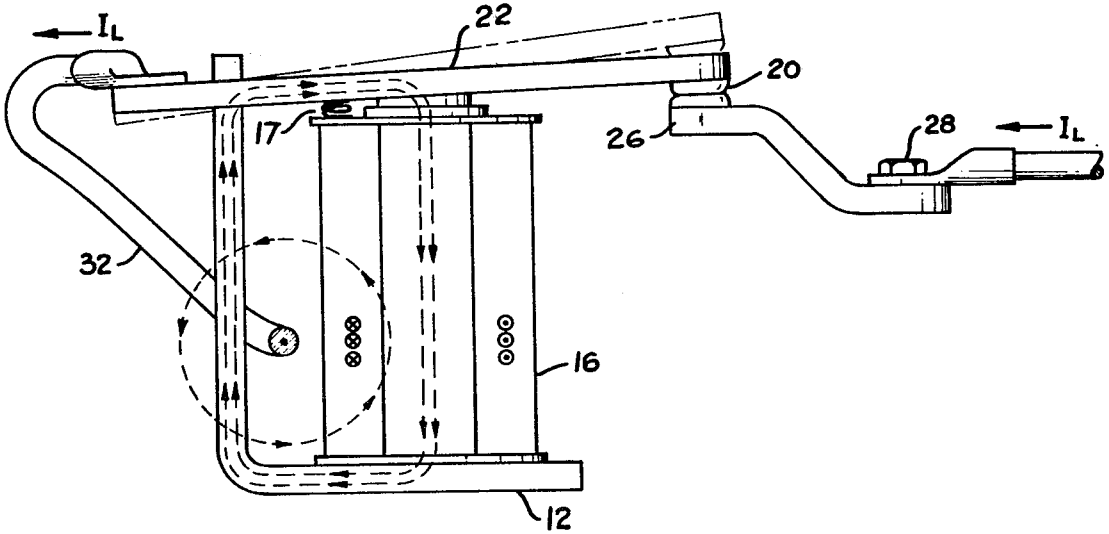
FIG. 3 illustrates the operation of the present invention.

FIG. 3 illustrates the operation of the invention in simplified schematic form, making use of the same numbers used in FIGS. 1 and 2 for identifying similar elements. With current flowing through the windings of coil 16 an MMF (illustrated by dashed lines) is set up which extends downwardly through the core of the coil, upwardly through the vertical portion of frame 12 and through contact arm 22 which is considered to include an armature in the illustration. The resulting forces urge the contacts tightly together, and load current $I_L$ flows from right to left, as shown. Current flowing through the movable contact arm 22 exits by way of flexible conductor 32 which is threaded between frame 12 and coil 16. Using conventional notation, the current direction through conductor 32 is shown by a dot, and extends out of the plane of the figure while current in the windings of coil 16 flows in the direction shown by the X's. Accordingly, a field is set up about the coil windings which extends in a clockwise direction and gives rise to the clockwise-extending MMF shown in the figure. At the same time, the magnetic circuit is linked by conductor 32, or more precisely the magnetic field thereabout which extends in a counterclockwise manner about the conductor. The flux linking conductor 32 thus opposes the MMF set up in the magnetic circuit by the windings of coil 16. The degree of flux linkage is not sufficient, however, to weaken the MMF to the point where spring 17 can overcome the magnetic force and open the contacts. The subtractive flux linkage is sufficient, however, to weaken the total MMF enough so that upon cessation of current through coil 16, the contactor opens measurably more rapidly than if the subtractive MMF were not present.

Figure 4:
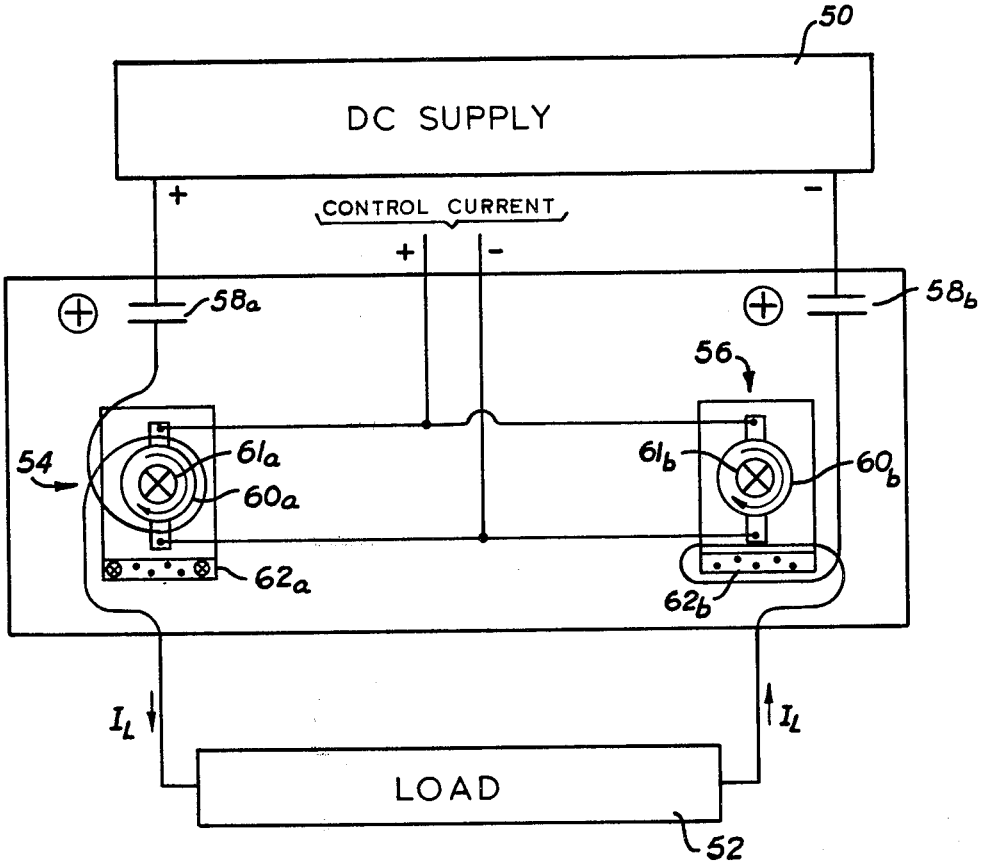
FIG. 4 shows a circuit interruption system making use of the teachings of the present invention.

FIG. 4 illustrates a system making use of the phenomena produced by the configuration of FIGS. 1 through 3. A bidirectional source of DC supply 50 provides controlled DC current to a load 52 which may be, for instance, an electric motor whose operation is to be controlled. A pair of polarized contactors 54, 56 are provided. Contactor 54 comprises a pair of normally-open contacts 58*a*, a coil 60*a* having a core 61*a* and a frame 62*a*. In like manner, contactor 56 includes a pair of normally-open contacts 58*b*, a coil 60*b* having a core 61*b*, and a magnetic frame 62*b*.

With the DC supply polarized as shown, current $I_L$ flows in the manner indicated. Current flowing through the load-carrying conductor links the magnetic circuits of both contactors 54 and 56. Illustrating an alternate configuration for providing linking, the load current carrying conductor of contactor 54 extends about coil 60*a* in a manner which causes a subtractive linking of the MMF of the magnetic circuit. MMF produced by the current in the coil, shown by a clockwise arrow, gives rise to MMF which extends downwardly through the core (indicated by an X) and upwardly out of the plane of the paper in the magnetic frame 62*a* (indicated by dots). MMF produced by linkage of the current-carrying conductor opposes this, and is illustrated by the X's within the frame 62*a*. Accordingly, the resultant MMF of contactor 54 is weakened.

At the same time, the MMF of contactor 56 is strengthened owing to the linkage of its magnetic circuit by the load current-carrying conductor of contactor 56. With the latter contactor, linkage is provided by passing the current-carrying conductor about the magnetic frame 62*b* in a counterclockwise manner, giving rise to an MMF directed out of the plane of the figure which aids the MMF produced by coil 60*b*.

When current to load 52 is to be interrupted current to winding 60*a* and 60*b* is cut off, causing the MMF in both contactors to decay. The MMF of left-hand contactor 54, being somewhat weaker than that of contact 56 owing to the opposing MMF of the load current-carrying conductor, decays more rapidly and contactor 54 opens before contactor 56. Contactor 54, being properly polarized for the direction of load current which has been flowing, interrupts the arc in the intended manner, the arc being forced into the arc chute of the contactor by a permanent magnetic field as explained with respect to FIGS. 1 and 2. Contactor 56, improperly polarized for load current $I_L$, is not called upon to sustain an arc as its opening is delayed sufficiently so that all arcing is borne by properly-polarized contact 54.

It will now be understood that upon the reversal of the current produced by DC supply 50, load current will flow downwardly through right-hand contactor 56 in which case the latter will be properly polarized, while contactor 54 is improperly polarized. However, reversal of current $I_L$ will effect a weakening of the MMF of contactor 56, and an aiding of the MMF of contactor 54. As described above this will result in the earlier opening of contactor 56, which is again properly polarized to extinguish the resulting arc.

Figure 5:
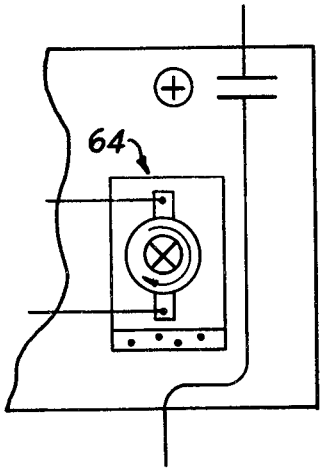
FIG. 5 shows a modification of the system of FIG. 4.

FIG. 5 shows the substitution of a standard contactor 64 for inventive contactor 56. With current $I_L$ flowing as shown in FIG. 4 the weakened MMF in contactor 54 causes it to open before the standard contactor. When the current reverses, the aided MMF in contactor 54 causes it to open later than standard contactor 64. The latter contactor, being properly polarized, extinguishes the resulting arc in the normal manner.

As will be evident from the foregoing description, certain aspects of the invention are not limited to the particular details of the examples illustrated. For example, it is contemplated that in some applications it may be practical to incorporate the invention into only one of two contactors, the differential in actuation time between the standard and the inventive contactor being sufficient to cause the inventive one to open first when properly polarized and to open last when the other contactor is properly polarized. It is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. A circuit interrupter for interrupting direct load current including a pair of separable contacts, an arc chute adjacent said contacts and permanent magnetic means associated with said arc chute for effecting movement of an arc drawn between said contacts, an armature for separating said contacts, a magnetic frame and a coil magnetically associated with said frame and armature to cause said armature to move relative to said frame, said armature, frame and coil comprising a magnetic circuit, a conductor electrically coupled to one of said contacts for carrying load current, said conductor linking said magnetic circuit to weaken the magnetic flux therein when load current flows in a first direction and to strengthen the magnetic flux therein when load current flows in a second direction whereby the release time required for the contacts to separate is varied depending upon the direction and magnitude of load current.

2. A circuit interrupter as defined in claim 1, further including a second interrupter also as defined in claim 1; means connecting said first and second interrupters in series circuit relationship such that load current flows in a first direction in said first interrupter for weakening the magnetic flux of the magnetic circuit thereof and in a second direction in said second interrupter for strengthening the magnetic flux in the magnetic circuit thereof; and means for applying a control signal substantially simultaneously to the coils of said first and second interrupters; whereby the contacts of said first interrupter are caused to separate before the contacts of said second interrupter.

3. The invention according to claim 2, wherein one of said separable contacts of each pair is mounted upon the armature thereof, and wherein said coil produces magnetic flux for causing said armature to approach said frame, closing said contacts; and further including spring means for biasing said contacts to an open position.

4. The invention defined in claim 3, wherein said permanent magnet means associated with said arc chutes are polarized to urge an arc drawn between said contacts into said arc chutes when load current flow is flowing in a first direction.

5. Means for interrupting DC current flowing from a source of reversible DC current to a load, comprising first and second contactors each having a pair of separable contacts, arc chutes adjacent said contacts, permanent magnet means associated with said arc chutes for effecting movement into said arc chutes of an arc drawn between said contacts when current flows through said contactor in a first direction, a magnetic circuit including a movable armature associated with one of said contacts, a magnetic frame carrying said armature, and a coil associated with said frame for inducing MMF in said magnetic circuit;

a conductor coupled to one of said contacts for carrying load current, said conductor linking said magnetic circuit in a direction such that current flow through said conductor in a first direction aids MMF in said circuit and current flow in a second, opposite direction opposes the MMF; and means coupling said contactors in series relationship such that current flows through one of said contactors in a first direction and through the second contactor in a second direction.

6. Means as defined in claim 5, further including means for coupling said contactors to opposite ends of a load to be supplied with DC current.

7. In a control system for interrupting DC power from a source of DC supply to a load, a first contactor coupled in series between said DC supply and a first end of said load, and a second contactor coupled in series between said DC supply and the opposite end of said load so that load current flows through both of said contactors, each contactor comprising a magnetic circuit including a frame, a coil and an armature means supplying a control signal to said contactors for actuating said magnetic circuit and causing said contactors to interrupt the circuit, conductor means for carrying said load current and linking the magnetic circuit of each of said contactors such that load current in one direction aids the MMF in the first contactors and weakens the MMF in the second contactor, and load current flow in the other direction aids MMF in the magnetic circuit of said second contactor, and weakens MMF in the magnetic circuit of said first contactor.

8. The invention defined in claim 7, wherein said load current carrying conductor means comprises flexible conductor means coupled to the movable one of said contacts of each of said contactors.

9. The invention defined in claim 7, wherein said load carrying conductor means extends about a portion of said frame for inducing an MMF therein.

10. The invention defined in claim 7, wherein said load carrying conductor means extends about a portion of said coil for algebraically adding MMF to MMF produced by said coil.

11. A circuit interrupter as defined in claim 1, further including a second, standard interrupter whose contacts separate in substantially the same release time regardless of the direction of load current; means connecting said first and second interrupters in series circuit relationship such that load current flows in a first direction in said first interrupter for weakening the flux of the magnetic circuit thereof and in a second direction in said second interrupter, and upon reversal of said load current the flux of said first interrupter is strengthened; and means for applying a control signal substantially simultaneously to the coils of said first and second interrupters; whereby when load current is flowing in a first direction the contacts of said first interrupter are caused to operate before the contacts of said second interrupter and when load current is flowing in a second direction the contacts of said first interrupter are caused to operate after the contacts of said second interrupter.

* * * * *